US006217119B1

(12) United States Patent
Cook et al.

(10) Patent No.: US 6,217,119 B1
(45) Date of Patent: Apr. 17, 2001

(54) EXTENDABLE ARMREST ASSEMBLY FOR A SEAT

(75) Inventors: Charles L. Cook, Thackerville, OK (US); Jeffrey S. Corey, Krum, TX (US); William C. Kahn, Denton, TX (US); Frank H. Schneck, Jr., Corinth, TX (US)

(73) Assignee: Paccar INC, Bellevue, WA (US)

( * ) Notice: Subject to any disclaimer, the term of this patent is extended or adjusted under 35 U.S.C. 154(b) by 0 days.

(21) Appl. No.: 09/425,067

(22) Filed: Oct. 21, 1999

(51) Int. Cl.[7] ..... A47C 7/54

(52) U.S. Cl. ..... 297/411.32; 297/411.3; 297/112; 297/113; 297/411.33

(58) Field of Search ..... 297/411.32, 411.3, 297/411.33, 113, 112

(56) References Cited

U.S. PATENT DOCUMENTS

| | | | | |
|---|---|---|---|---|
| 3,550,958 | * | 12/1970 | Krein | 297/411.32 |
| 3,612,606 | * | 10/1971 | Swenson | 297/411.32 X |
| 5,290,092 | * | 3/1994 | Geer | 297/411.32 |
| 5,547,257 | * | 8/1996 | Lavender | 297/411.32 |

* cited by examiner

*Primary Examiner*—Peter M. Cuomo
*Assistant Examiner*—Rodney B. White

(57) ABSTRACT

A seat assembly (10, 100) is disclosed which utilizes a retractable armrest (16) which can be retracted into a recess (20) in the seat back (12) of the seat assembly to maximize the available space around the seat assembly. The retractable armrest 16 can be moved from the retracted position to the deployed position by a pneumatic cylinder (38), coil spring (106) or other actuator. The retractable armrest (16) is guided in this motion by a guide pin (30) moving within a guide slot (32) in a mount on the seat back.

20 Claims, 6 Drawing Sheets

EXTENDABLE ARMREST ASSEMBLY FOR A SEAT

BACKGROUND OF THE INVENTION

In vehicles, such as trucks and automobiles, it has become common to provide an armrest beside or integral with a seat to provide a driver or passenger the opportunity to rest their arm thereon. Present seat manufacturers use fixed, or folding armrests on the side of seats. These armrests protrude into the space adjacent to the seat even when not in use, making actions such as ingress and egress difficult. Also, the space occupied by the armrest is unavailable for storage or other uses.

A need exists for improved seat assemblies with armrests which provide more efficient use of space and provide greater comfort and convenience for driver and passenger use.

SUMMARY OF THE INVENTION

In accordance with one aspect of the present invention, a seat assembly is provided. The seat assembly includes a seat portion and an armrest mounted to the seat portion for linear motion in a first direction and pivotal motion in a rotational plane generally perpendicular to the first direction. The armrest is moveable between a first position and a second position in the first direction. At least one of the first and second positions is a retracted position with the armrest retracted into the seat portion of the seat assembly. The other position is a deployed position, permitting the armrest to pivot in the rotational plane.

In accordance with another aspect of the present invention, a device is provided for urging the armrest in the first direction from the first position to the second position. The device can be a pneumatic cylinder, electric solenoid, or mechanical spring. The device can be used to urge the armrest from the retracted position along the first direction to the deployed position.

In accordance with another aspect of the present invention, the armrest can be provided with a shaft having a pin extending therefrom. The seat portion has a mount defining a cylindrical portion with a groove, the shaft received in the cylindrical portion with the pin in the groove. The groove is configured to have a linear portion along the first direction which transitions into a portion extending about the circumference of the cylindrical portion for movement of the armrest in the rotational plane.

BRIEF DESCRIPTION OF THE DRAWINGS

For a more complete understanding of the present invention and the advantages thereof, reference is now made to the following description taking in conjunction with the accompanying drawings, in which.

DETAILED DESCRIPTION OF THE INVENTION

Figure 1:
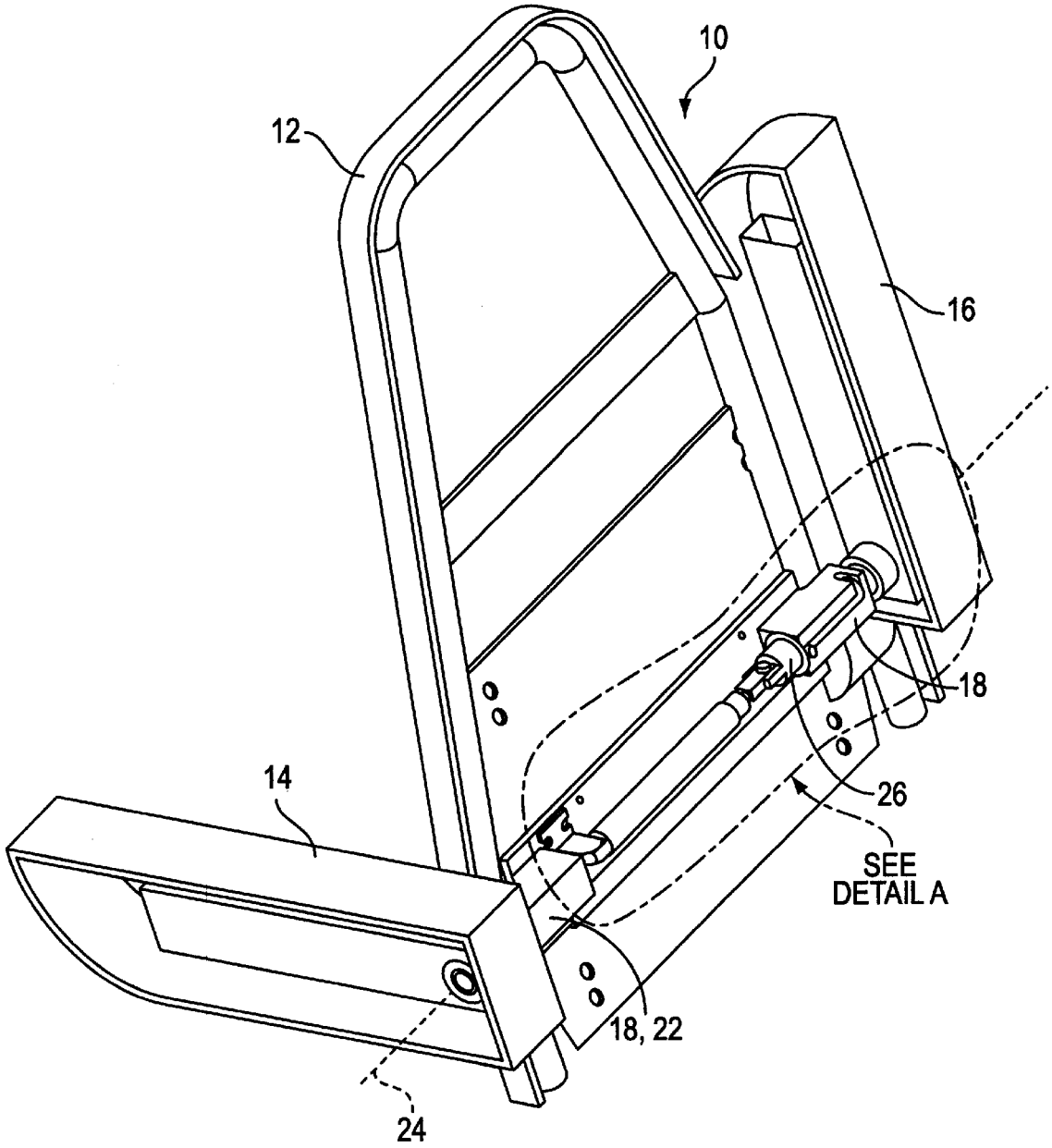
FIG. 1 is a perspective view of a seat assembly forming a first embodiment of the present invention.
Figure 2:
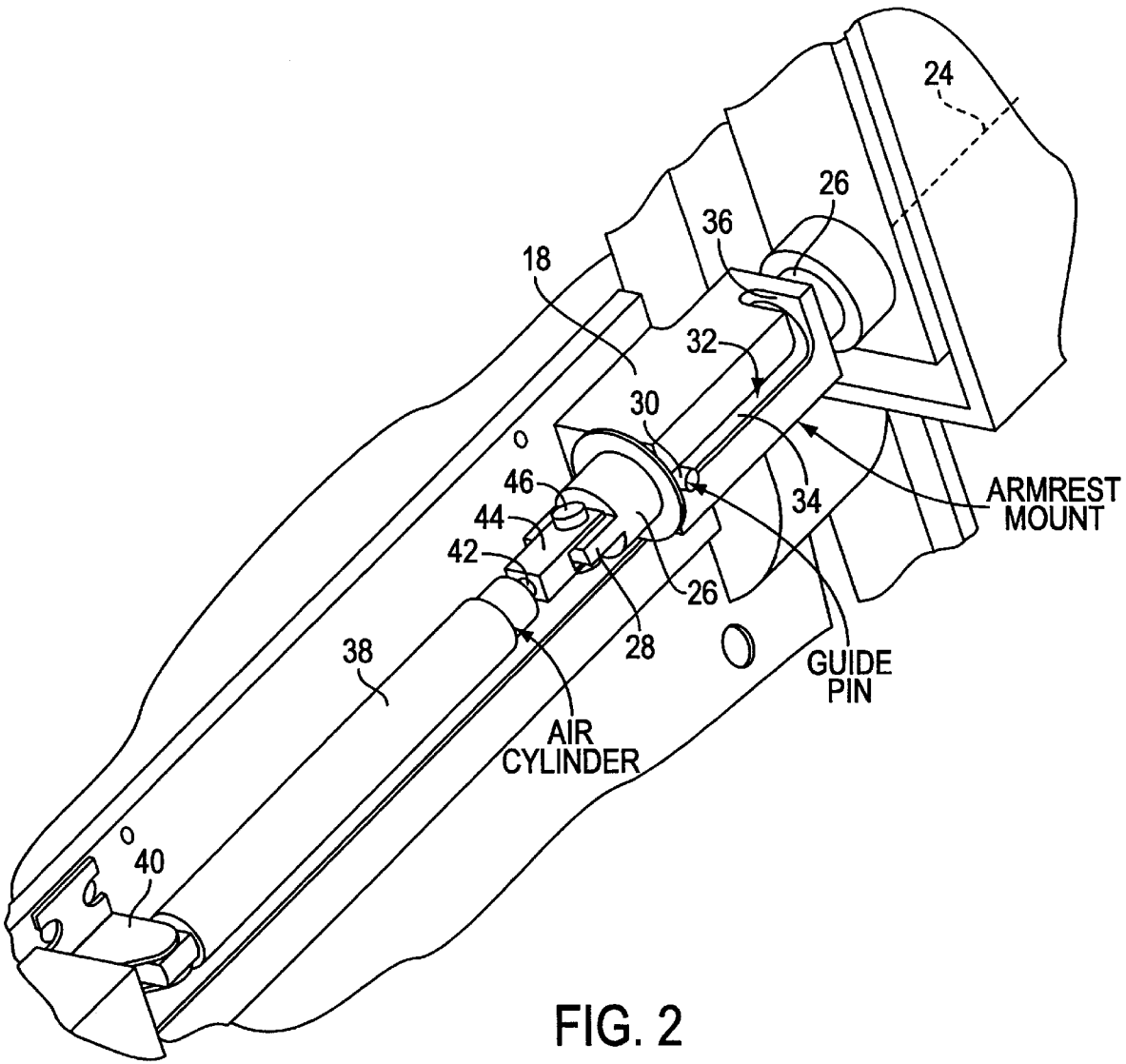
FIG. 2 is a detailed view of the first embodiment of FIG. 1 illustrating the pneumatic cylinder and armrest mount.
Figure 6:
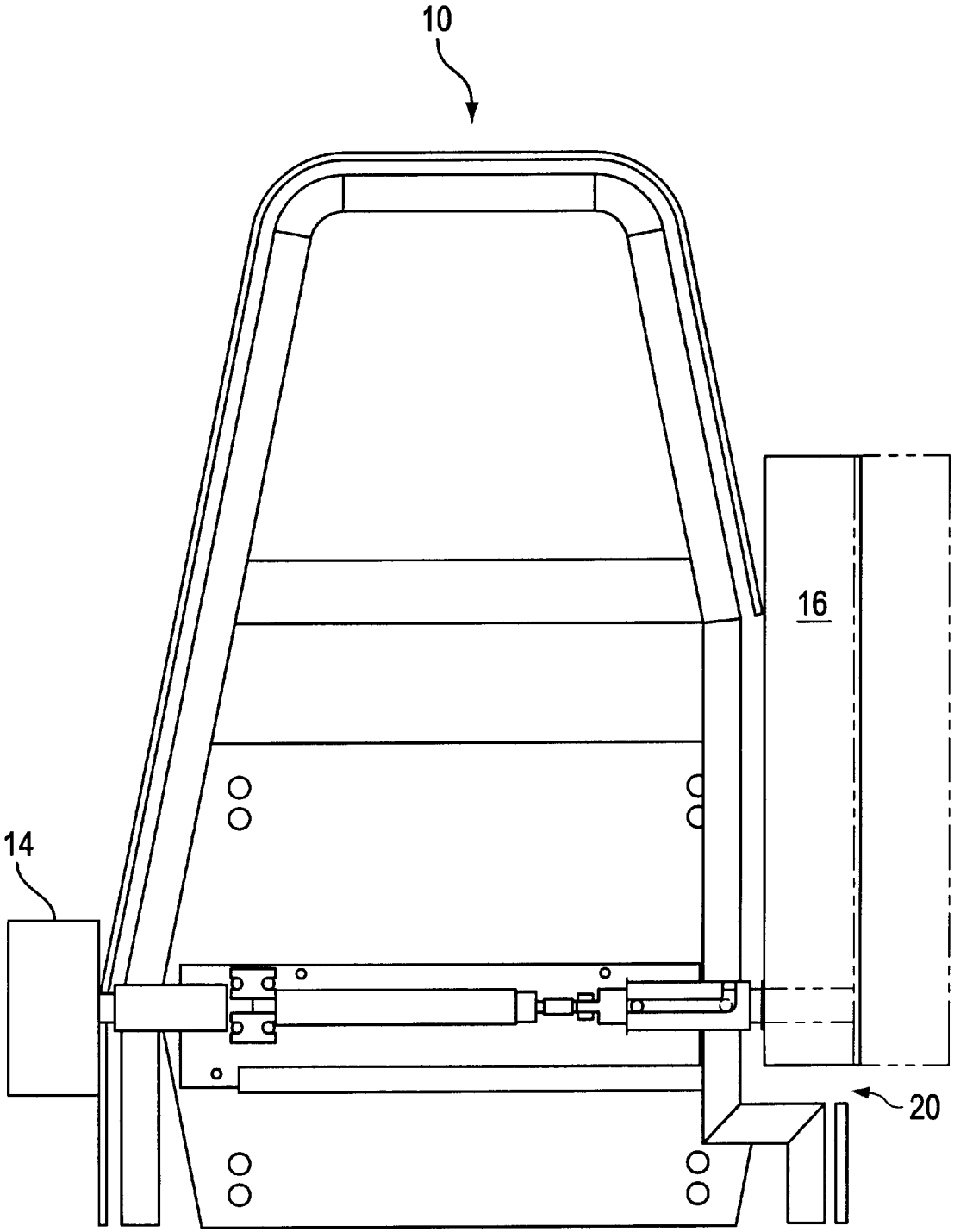
FIG. 6 is a back view of the seat assembly of the first embodiment of the present invention.

With reference now to the accompanying drawings, and in particular to FIGS. 1, 2 and 6, there is shown a left side seat assembly 10 forming a first embodiment of the present invention. The seat assembly includes a seat back 12, a first, conventional armrest 14 on the outboard side of the seat back 12 and a retractable armrest 16 on the inboard side of the seat back 12.

As can be readily understood, the seat back 12 can be mounted to other seat components, such as a generally horizontally extending seat portion which, in turn, can be mounted directly to a vehicle, or supported on a pedestal providing a shock absorber function, or permitting the seat to pivot about a vertical axis to aid in ingress and egress. Suitable upholstery and cushioning will be mounted on the seat back 12, armrests 14 and 16 and other seat components as is well known in the industry.

The armrest 14 is pivotally mounted to the seat back 12 by an armrest mount 22 as conventionally known in the industry. However, retractable armrest 16 is mounted to be stored in a retracted position, as seen in FIG. 6, with the retractable armrest 16 retracted into a recess 20 in the side of seat back 12 when the armrest is not used. This maximizes the available space around the seat assembly. Once the driver or passenger is seated, the retractable armrest 16 can be moved out of the recess in the seat back 12 and deployed by the occupant for optimal comfort.

With specific reference to FIGS. 1 and 2, the first embodiment will be described in detailed. The seat back 12 mounts conventional armrest mount 22 on the outboard side and the retractable armrest mount 18 on the inboard side. The conventional armrest 14 has a rod (not shown) which extends into and is rotatably mounted within the conventional armrest mount 22, which allows the armrest 14 to pivot about axis 24 in a conventional known manner to allow the occupant of the seat to move the armrest down to the horizontal position shown in FIG. 1 for use or pivot it back to the vertical position parallel with the seat back 12.

The retractable armrest 16 has a rod 26 which extends through a cylindrical opening through the mount 18 and ends in a spline 28. The length of the rod 26 exceeds the length of the mount 18 so that the rod can move along the axis 24 to move the armrest 16 between the retracted position in the recess 20 of the seat to the deployed position where it can be pivoted down for use.

Extending from the rod 26 is a guide pin 30 which is received in a guide slot 32 formed in the mount 18. As can be seen in the Figures, the guide slot 32 has a linear portion 34 which extends along the axis 24 and transitions into a circumferential portion 36 which extends for an arc of about 90 degrees or so in a plane perpendicular to the axis 24.

A pneumatic cylinder 38 is mounted on the seat back 12 with the base of the pneumatic cylinder securely mounted to a bracket 40 on the seat back 12. The piston rod 42 of the pneumatic cylinder extends to a clevis 44 which extends over the spline 28. A pin 46 passes through aligned holes in the clevis 44 and spline 28 to secure the piston rod to the rod 26.

The pneumatic cylinder 38 is preferably a single acting cylinder which, when a gas under pressure is provided to the cylinder, extends the piston rod 42 in the direction of the mount 18. This causes the armrest 16 to move from the retracted position to the deployed position. Once the armrest 16 is in the deployed position, the occupant of the seat can manipulate the armrest 16 as desired by pivoting the armrest about axis 24. The guide pin and guide slot 32 ensure that the armrest 16 will remain in the vertical orientation until it is clear of the seat back. The piston rod 42 can rotate about the axis 24 with rod 26. Alternatively, a rotary coupling could be installed between rod 26 and piston 42.

Preferably, the pneumatic cylinder 38 has an internal spring which urges the piston rod 42 to the retracted position within the cylinder. Alternatively, a spring external the pneumatic cylinder can serve the same function. When the armrest 16 is to be returned to the retracted position, the armrest 16 need only be moved to the vertical position, whereupon the spring within the pneumatic cylinder will draw the armrest 16 into the retracted position within the recess 20.

The gas pressure in the pneumatic cylinder 38 deploying the armrest could be removed immediately after the occupant of the seat pivots the armrest down into the normal use position. In that position, the spring within the pneumatic cylinder could not retract the armrest because the pin 30 would contact the side of guide slot 32 in the circumferential portion 36 to prevent movement of the armrest 16 along axis 24. When the occupant wished to retract the armrest, all that would be necessary would be to pivot the armrest up to the vertical position, allowing the pin 30 to enter the linear portion 34 of the guide slot 32. The spring within the pneumatic cylinder would then draw the armrest 16 into the retracted position. Alternatively, gas pressure can be maintained within the pneumatic cylinder 38 until the armrest 16 is actually to be retracted. This would permit the occupant of the seat to move the armrest 16 between the vertical position and the horizontal position as often as desired without the armrest 16 actually be retracted into the recess 20.

While the pneumatic cylinder 38 has been described as a single acting cylinder to deploy the armrest 16, the pneumatic cylinder can alternatively be a single acting cylinder to retract the armrest 16 within the recess 20. In such a situation, a spring could be mounted in the pneumatic cylinder or external to the pneumatic cylinder to urge the armrest 16 to the extended position in the absence of gas pressure within the pneumatic cylinder 38. Alternatively, the pneumatic cylinder 38 can be a double acting cylinder, allowing pressure to be inserted on one side of the piston within the cylinder to deploy the armrest and on the other side of the piston to retract the armrest. Gas under pressure can be supplied from an engine driven compressor, or other source, and controlled by suitable controls conveniently located for the seat occupant. Further, the pneumatic cylinder 38 could be replaced by any other type of actuator, such as a electrical solenoid actuator, motor driven ball screw actuator or other suitable mechanism.

Figure 3:
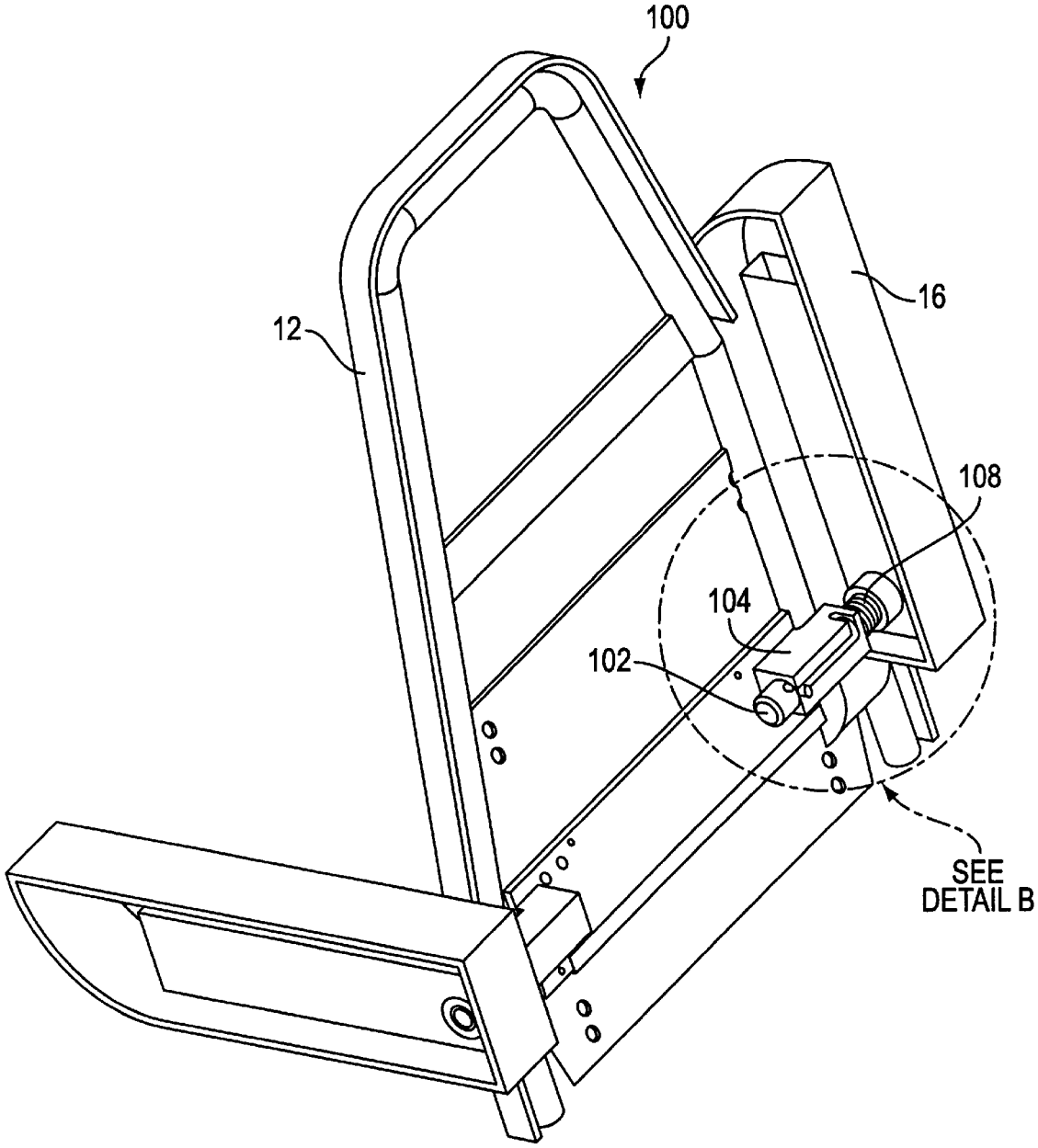
FIG. 3 is a perspective view of a seat assembly forming a second embodiment of the present invention.
Figure 4:
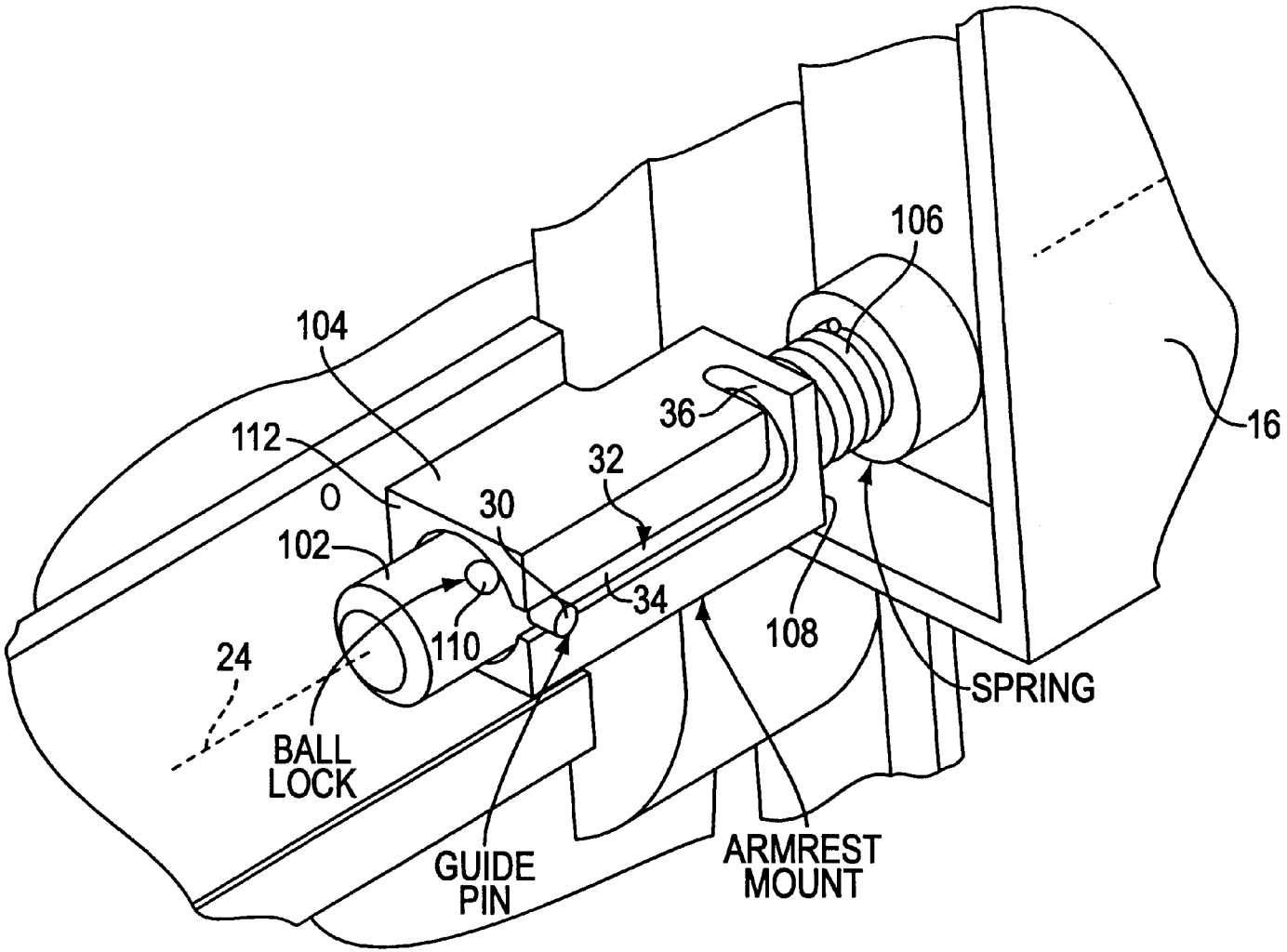
FIG. 4 is a detailed view of the armrest mount and spring of the second embodiment of FIG. 3.

With reference to FIGS. 3 and 4, a seat assembly 100 forming a second embodiment of the present invention will be described. Numerous components in seat assembly 100 are identical to those in seat assembly 10 and are identified by the same reference numerals. Retractable armrest 16 is provided with a modified rod 102 which is received in a modified armrest mount 104. Rod 102 mounts guide pin 30 and mount 104 has a guide slot 32 with the linear portion 34 and circumferential portion 36.

A coil spring 106 is circumferentially fit about the portion of the rod 102 between the outer end 108 of the mount 104 and the armrest 16 itself The spring 106 acts to urge the rod 102 along the axis 24 in a direction to deploy the armrest 16. A spring loaded ball 110 is mounted at the inner end of the rod 102 which extends to engage the inner end 112 of the mount 104 when the armrest 16 is in the retracted position. The force of the spring loaded ball 110 acting on the inner end 112 is sufficient to overcome the force of the spring 106 so that the armrest 16 is held in the retracted position. The occupant of the seat will manually be required to draw the armrest 16 out of the recess 20 into the deployed position by overcoming the force of the spring loaded ball 110. Once the resistance of the spring loaded ball 110 is overcome, the spring 106 assists the occupant in moving the armrest 16 to the deployed position. The armrest 16 can then be pivoted about the axis 24, with the guide pin 30 running in the circumferential portion 36 of the guide 32, to move the armrest 16 to a horizontal position or other comfortable position for use.

To retract the armrest 16 in the seat assembly 100, the occupant would simply need to rotate the armrest 16 about axis 24 to the vertical position and then manually push the armrest 16 into the recess, overcoming the force of spring 106, until the spring loaded ball 110 pops out into engagement with the inner end 112 of the mount 104 to secure the armrest 16 in the retracted position.

The transition between the guide slot linear portion 34 and circumferential portion 36 can be tailored to the desired behavior of the seat assembly. If the transition between linear portion 34 and circumferential portion 36 is relatively abrupt, the air cylinder, spring or other actuator will essentially simply cause the armrest 16 to move from the retracted position to the deployed position but cause the armrest 16 to remain in the vertical orientation. The armrest 16 must be manually moved to the horizontal position by the occupant. If a more curved transition is formed between the linear portion 34 and the circumferential portion 36, the force of movement of the armrest 16 from the retracted position to the deployed position can cause the armrest to be automatically forced forward and down into the horizontal position for use.

Figure 5:
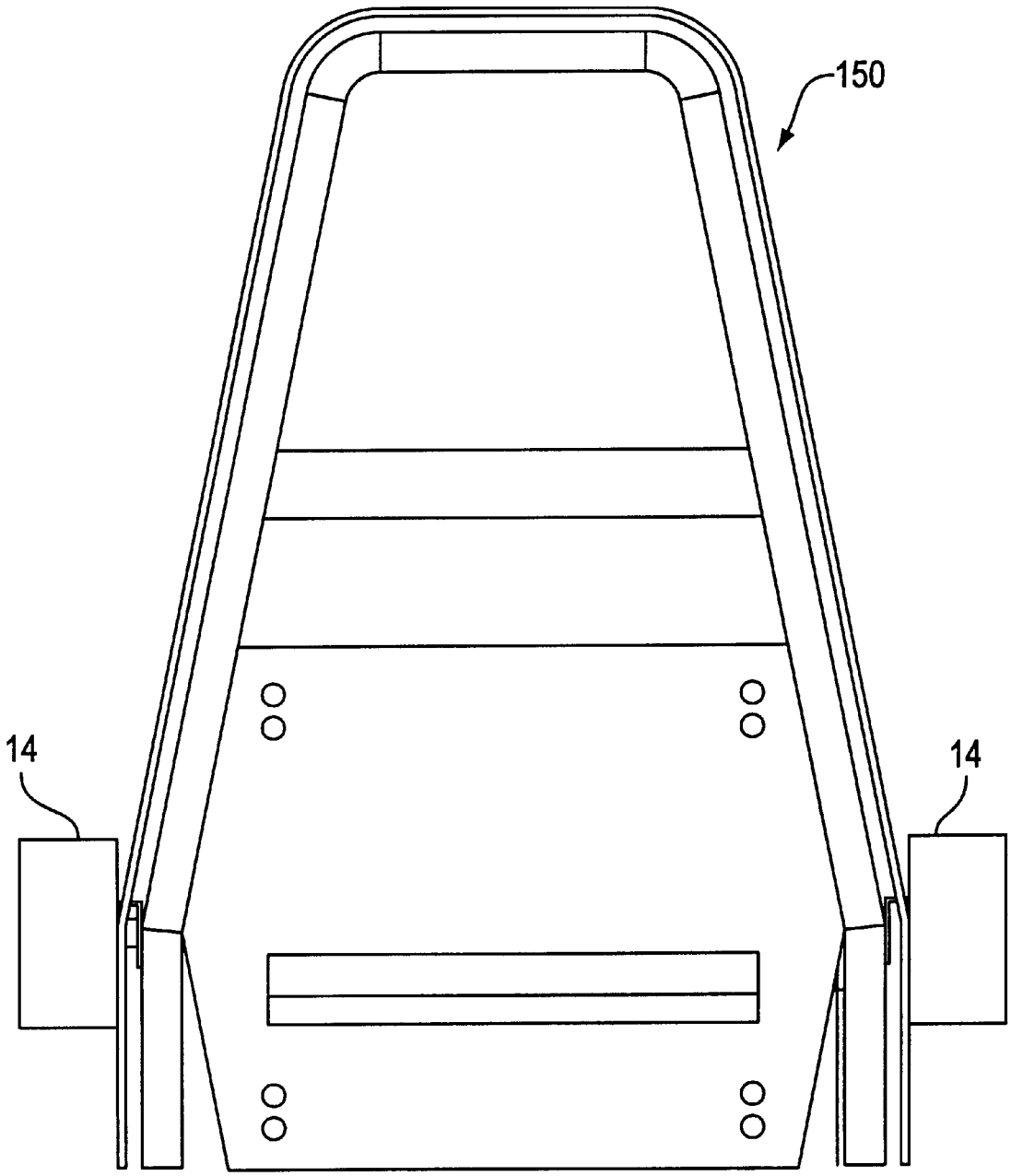
FIG. 5 (PRIOR ART)
FIG. 5 is a back view of a seat assembly of the type known in the art.

With reference to FIGS. 5 and 6, the savings of width in the seat assembly is well illustrated. In FIG. 5 and FIG. 6, the seat backs 150 and 12 have substantially the identical width. A conventional armrest 14 is mounted on the outboard side of each seat back 150 and 12 and can be seen to occupy a significant portion of the entire width of the seat assembly. A conventional armrest 14 is also illustrated on the inboard side of the conventional seat assembly 150 in FIG. 5. In contrast, the improved seat assembly 10 of FIG. 6 illustrates a retractable armrest 16 on the inboard side of the seat assembly 10 which is in the retracted position, reducing the width occupied by the seat assembly. This maximizes the available space around the seat assembly by providing for retraction of the armrest into the seat back when not in use.

Although several embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit and scope of the invention.

We claim:

1. A seat assembly, comprising:

a seat member; and an armrest moveably mounted to the seat member, wherein the armrest is capable of (i) linear motion in a first direction between first and second positions relative to the seat member and (ii) pivotal motion in a rotational plane generally perpendicular to the first direction, wherein the armrest is positioned proximate to the seat member when the armrest is in the first position, and the second position is a deployed position, where in the deployed position, the armrest is spaced apart from the seat member in the first direction.

2. The seat assembly of claim 1 further having an actuator mounted on the seat member to move the armrest in the first direction from the first position to the deployed position.

3. The seat assembly of claim 2 wherein the actuator has a spring to move the armrest from the deployed position to the first position.

4. The seat assembly of claim 2 wherein the actuator is a pneumatic cylinder.

5. The seat assembly of claim 2 wherein the actuator is an electrical solenoid.

6. The seat assembly of claim 2 wherein the actuator is a spring.

7. The seat assembly of claim 1 wherein the armrest has a rod thereon extending in the first direction, and the seat member has a mount thereon having a cylindrical aperture adapted to receive the rod on the armrest, and wherein when the rod is received within the mount, the rod is pivotal relative to the mount about the first direction within the rotational plane.

8. The seat assembly of claim 7 wherein the rod has a spring loaded ball therein to engage the mount to hold the armrest in the first position.

9. The seat assembly of claim 7 wherein the rod has a guide pin thereon and the mount forms a guide slot therein, the guide pin received in the guide slot, the guide slot having a linear portion extending along the first direction and a circumferential portion extending parallel to the rotational plane.

10. The seat assembly of claim 1 wherein the seat portion is a seat back, and the seat member is shaped to closely receive the armrest when the armrest is in the first position, such seat back shape including a notch, and this notch substantially complements the armrest so that the notch substantially accepts the armrest when the armrest is in the first position.

11. A seat assembly, comprising:

a seat back;

an armrest mounted to the seat back for linear motion in a first direction between first and second positions and pivotal motion in a rotational plane generally perpendicular to the first direction, wherein such pivotal motion enables movement of the armrest between at least a generally vertical position to a generally horizontal position;

a mount secured to the seat back having a generally cylindrical passage therethrough extending along the first direction, the mount having a guide slot having a linear portion extending along the first direction and a circumferential portion extending in the rotational plane;

a rod secured to the armrest, the rod passing through the cylindrical passage of the mount and having a guide pin extending therefrom received in the guide slot in the mount; and an actuator mounted on the seat back and contacting the rod to move the rod in the first direction and to move the armrest from the first position to the second position, wherein at the first position, the armrest is proximate to the seat back, and at the second position, the armrest is spaced apart from the seat back.

12. The seat assembly of claim 11 wherein the actuator is a single acting pneumatic cylinder.

13. The seat assembly of claim 11 wherein the actuator is an electrical solenoid.

14. The seat assembly of claim 11 wherein the actuator is a spring positioned between the mount on the seat back and the armrest.

15. The seat assembly of claim 14 wherein the rod has a spring loaded ball to engage an end of the mount when the armrest is in the first position.

16. The seat assembly of claim 11 wherein a spring acts between the seat back and the armrest to urge the armrest into the first position.

17. A method for deploying an armrest in a seat assembly having a seat back, the seat back having a longitudinal axis, the method comprising the steps of:

actuating an actuator to move an armrest from a retracted position relative to the seat back of the seat assembly along a first direction to a deployed position a predetermined distance away from the seat back; and rotating the armrest from a generally vertical position to a generally horizontal position for use, wherein the first direction is perpendicular to the longitudinal axis of the seat back.

18. The method of claim 17 further comprising the step of pivoting the armrest from the generally horizontal position to the generally vertical position and permitting the armrest to be moved in the first direction into the retracted position under the influence of a spring acting between the seat back and the armrest.

19. The method of claim 17 further comprising the step of overcoming the force of a spring loaded detent in a rod secured to the armrest acting against an end of a member mounted to the seat back to move the armrest in the first direction to the deployed position.

20. The seat assembly of claim 1 wherein in the deployed position, the armrest is capable of pivoting in the rotational plane.

* * * * *